United States Patent [19]

Mette

[11] 4,270,585

[45] Jun. 2, 1981

[54] FILLING DEVICE HAVING AN AIR RETURN PIPE FOR FILLING CONTAINERS WITH GAS-CONTAINING LIQUID

[75] Inventor: Manfred Mette, Hamburg, Fed. Rep. of Germany

[73] Assignees: Ortmann & Herbst GmbH, Hamburg, Fed. Rep. of Germany; Rogers Corporation, Rogers, Conn.; Rogers Corporation, Rogers, Conn.

[21] Appl. No.: 15,284

[22] Filed: Feb. 26, 1979

[30] Foreign Application Priority Data

Feb. 27, 1978 [DE] Fed. Rep. of Germany ..... 2808345

[51] Int. Cl.[3] ..... B65B 31/00

[52] U.S. Cl. ..... 141/37; 141/39; 141/302; 141/392

[58] Field of Search ..... 141/4–8, 141/37, 39, 44, 48, 52, 54, 57, 181, 198, 283, 284, 288, 302, 307, 308, 392

[56] References Cited

U.S. PATENT DOCUMENTS

| | | | |
|---|---|---|---|
| 1,915,066 | 6/1933 | Meyer | 141/39 |
| 2,138,355 | 11/1938 | Ryan et al. | 141/48 |
| 2,605,949 | 8/1952 | Stern | 141/39 |
| 2,676,742 | 4/1954 | Day et al. | 141/39 |

FOREIGN PATENT DOCUMENTS

| | | | |
|---|---|---|---|
| 1174196 | 7/1964 | Fed. Rep. of Germany | 141/44 |

*Primary Examiner*—Frederick R. Schmidt
*Attorney, Agent, or Firm*—Michael J. Striker;

[57] ABSTRACT

The filling device for use in connection with a rotary filling machine, includes a housing enclosing an air-return chamber, a vertically reciprocating air-return pipe projecting with its upper part into the air-return chamber, a rack-and-pinion drive rotatably supported in the air-return chamber and having a rack secured to the upper part of the pipe and a pinion supported for rotation on a shaft passing through the housing and driven via a lever by a cam secured to the non-rotating part of the filling machine.

6 Claims, 1 Drawing Figure

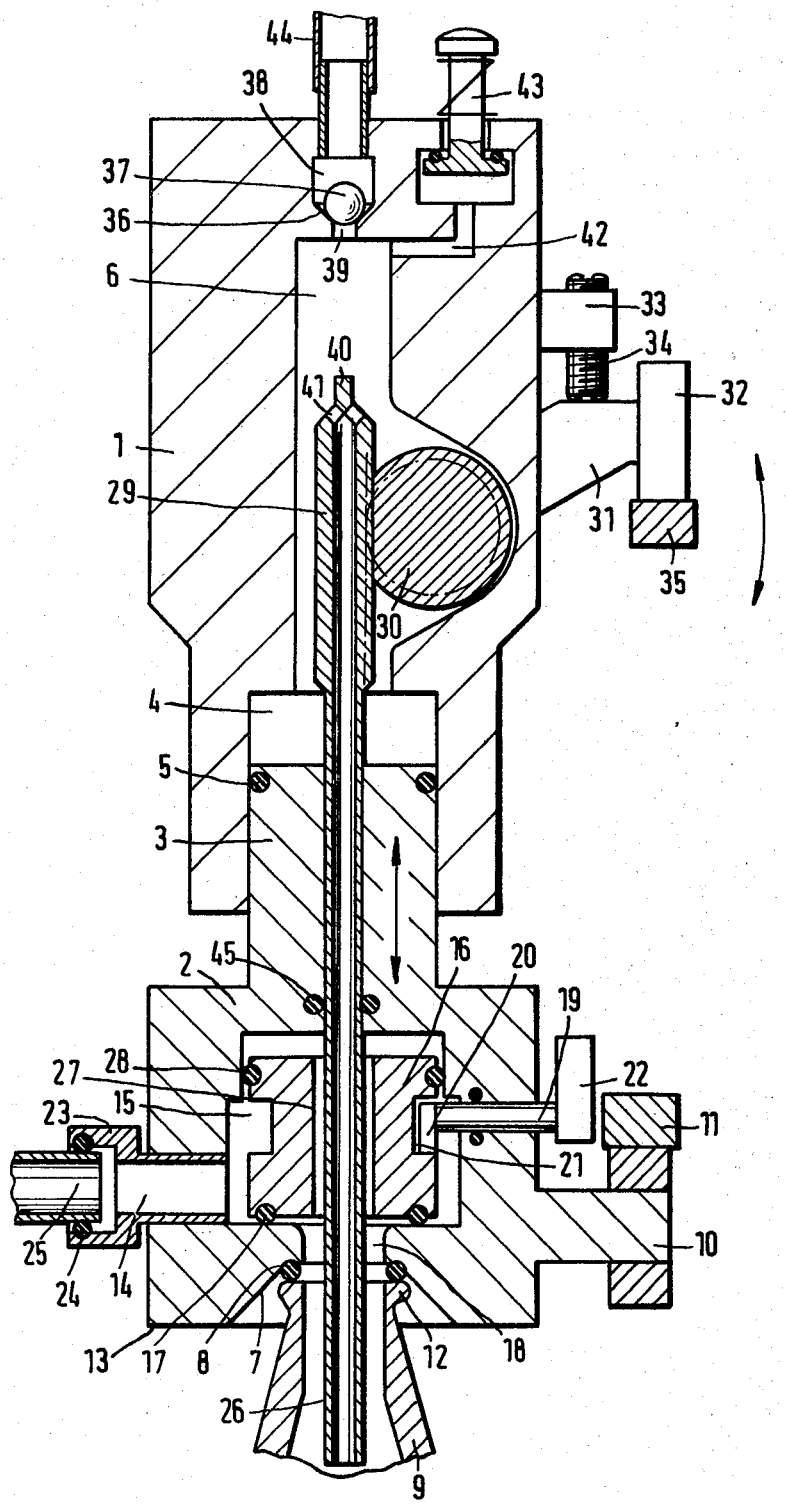
44
38
43
37
36
42
39
6
33
34
40
41
32
1
29
31
35
30
4
5
3
2
45
16
20
19
27
28
22
15
23
11
21
25
10
24
14
13
17
8
7
12
18
26
9

FILLING DEVICE HAVING AN AIR RETURN PIPE FOR FILLING CONTAINERS WITH GAS-CONTAINING LIQUID

BACKGROUND OF THE INVENTION

This invention relates generally to devices for filling a gas-pressurized liquid into containers and more particularly it relates to a device for filling $CO_2$-containing beverages into containers, the device having a vertically movable air-return pipe adapted for movement into a filling position in which it partially enters the container to determine the maximum filling level, and into an elevated position above the container to permit the exchange of the container.

A filling device of the above-described type is known from the German Pat. No. 1,174,196. In the construction according to this patent, the filling devices are situated at the bottom of a filling tank storing the gas-pressurized liquid. The air-return pipe of each filling device is slidably supported for a reciprocating vertical movement and projects upwardly through the head part of the filling device as far as to the gas-filled upper space of the tank. High filling pressures in the counter-pressure filling devices of this type do not cause any substantial sealing problems due to the fact that the interior of the filling device and the interior of the filling tank are subject to the same pressure in most stages of the filling operation. Also the connection of the open end of the air-return pipe with the gas-filled space of the tank for producing the initial pressure and for returning the air in the container presents in this construction no problems.

Filling devices of the above-described type which are arranged off the bottom of the filling tank have been devised in the British patent specification No. 371,498. The filling device itself has substantially the identical structure as that of the aforementioned German patent, but the free upper end of the air-return pipe projects through the head of the filling device into the free atmosphere and the movement of the pipe is derived from a direct drive, for example by means of lifting cams. The connection to the pressurized gas is effected via flexible conduits acting on the air-return pipe or via a shiftable connection in the head of the filling device. The disadvantage of this solution is the necessity to provide sliding seals for the air-return pipe which in the case of high filling pressures such as 6 Bars, for example, are prone to wear. In addition, the gas connection to the air-return pipe is complicated and its structure is expensive and demanding on maintenance.

SUMMARY OF THE INVENTION

A general object of this invention is, therefore, to overcome the aforementioned disadvantages.

More particularly, it is an object of the invention to provide an improved filling device of the above-described type which is arranged outside the tank for storing the gas-pressurized liquid and which simplifies the connections to the pressurized gas and to the air-return pipe.

Another object of the invention is to provide such an improved filling device which makes the sealing against the high-pressure gas more simple.

In keeping with these objects, and others which will become apparent hereafter, one feature of the invention resides, in a filling device having a reciprocating vertically movable air-return pipe, in the provision of a housing enclosing an air-return chamber whereby the upper portion of the pipe projects into the chamber, and reversible driving means arranged in the chamber and engaging the pipe to impact the reciprocating movement thereto.

In this construction all gas connectors into the air-return chamber can be arranged in the stationary walls of the housing without the necessity to use slidable connectors or flexible conduits following the movement of the air-return pipe. The reciprocating drive for the air-return pipe requires only an entrance in the wall of the housing of the filling device for supporting the rotary drive shaft and the sealing of this entrance is trouble-free and superior to the aforementioned slidable sealings. The installation of the reciprocating drive which preferably includes a rack-and-pinion drive, permits an extremely accurate vertical adjustement of the positions of the pipe which is necessary for adjusting the filling condition in the bottle. More particularly, the rack-and-pinion drive has a substantially lower play in comparison with conventional lever mechanisms. In addition, the construction of the filling device according to this invention is extraordinarily compact insasmuch as it dispenses with the outwardly projecting open end of the air-return pipe which in conventional filling devices of this type exceeds the head about a variable distance depending on the position of the pipe.

From the U.S. Pat. No. 2,138,355 a filling device is known which is arranged outside the filling tank and which has a vertically movable pipe driven by means of a rack-and-pinion drive arranged above the filling device. This lifting drive, however, is arranged in the free atmosphere so that sealing means slidably engaging the upper end of the pipe are necessary and in the case when this structure is to be used as a counterpressure filling device, considerable problems will arise.

Another feature of this invention resides in the provision of a rack-and-pinion drive for the air-return pipe which is arranged in the air-return chamber, the rack being attached to the upper end of the pipe and the pinion being mounted on a shaft which passes through the walls of the housing and is terminated at one end with a driving lever which abuts against an adjustable stop member projecting from the housing. In this manner, it is possible to individually adjust on each filling device the level of the liquid filled into the container.

Still another feature of this invention resides in the provision of a driving cam orbiting in an operative proximity to the driving lever on a part of the rotary filling apparatus which is located outside the filling device. This control cam can be adjustable so that by a single adjustment thereof, it is possible to control all filling devices in the filling apparatus and thus the level of the liquid discharged in the containers. Accordingly, when the size of the containers to be filled is changed, the changeover time for the readjustment of the filling apparatus is considerably shortened in comparison with conventional devices where it is necessary to readjust all individual filling devices.

Still a further feature of this invention resides in the provision of a gas valve arranged in the wall of the housing opposite the upper end of the air-return pipe whereby in order to introduce the initial gas pressure into the container to be filled the gas valve is momentarily opened by an additional lift of the air-return pipe. In this manner, the reciprocating drive for the air-return pipe which can be arbitrarily controlled in a wide range takes over also the function of controlling the gas valve for the initial pressurizing of the container. A separate control mechanism can, therefore, be dispensed with.

The gas valve in the device of this invention is preferably in the form of a ball-retaining valve, the ball of which during the filling process is lifted by the air-return pipe. Such a ball-retaining valve for introducing the initial pressure gas has the advantage of being particularly simple in structure. The valve ball is held in position in the valve seat by its own weight and insures a reliable seal against the outer gas pressure. To introduce the outer gas for the initial pressurizing of the container, the ball is momentarily lifted by the air-return pipe. During the subsequent filling process the valve ball which is made of a light material is raised by the stream of the return air slightly above the conical surface of its seat and permits the return air to escape from the container. This construction of the gas valve has an additional advantage of an increased safety of the filling operation since in the event when a container breaks up the ball returns immediately on its seat and prevents the escape of the pressurized gas. Furthermore, the filling device of this invention includes a valve chamber for shutting off the gas-pressurized liquid, whereby the lower part of the air-return pipe passes through this valve chamber and the intermediate part of the pipe above the valve chamber is sealingly guided and the air-return chamber is further provided with a pressure-relief valve.

During the filling operation, the air-return chamber which accommodates the upper portion of the air-return pipe is sealed off against the pressurized liquid flowing into the valve chamber, so that the reciprocating drive for the pipe is maintained in a dry condition. The column of liquid which upon the completion of each filling operation remains in the lower portion of the air-return pipe, is discharged by lifting the air-return pipe into its elevated position. During the subsequent depressurizing step, in which the pressure in the upper part of the container is equalized to the pressure of the outer atmosphere, the arrangement of the pressure-relief valve at the uppermost part of the filling device has the desirable effect that it is only the gas which is blown out from the container. Any entraining of the liquid which takes place in conventional devices where the pressure-relief valve is arranged at the outlet for the liquid, is reliably avoided. Furthermore, this arrangement has the advantage that by virtue of the removal of the pressure-relief valve from the outlet of the liquid the latter becomes more simple and improves its flow quality.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE is an axial cross-sectional view of the filling device according to this invention for use in a rotary filling machine employing a plurality of such filling devices for charging $CO_2$-containing beverages, such as beer, lemonade and the like, into bottles. The filling device is illustrated in its filling position in contact with the rim of a bottle.

DESCRIPTION OF THE PREFERRED EMBODIMENTS

The illustrated filling valve arrangement is designed for operation in connection with a rotary filling machine in which a carbonated beverage such as beer, lemonade and the like is continuously filled into containers such as bottles or cans. According to the designed efficiency for the filling machine the latter may contain a plurality of such filling valve arrangements. In the drawing, the filling valve arrangement of this invention is illustrated in its filling position in contact with a bottle 9.

The filling valve includes two housing parts of which one in the illustrated example is made as a stationary cylindrical head 1 which is fixedly mounted to a non-illustrated rotary filling machine. The other part of the housing is a lower extension of a piston 3, the latter being axially movable in a cylindrical recess 4 of the cylindrical head 1. Piston 3 is sealed with respect to the cylindrical wall of recess 4 by means of sealing ring 5. A central portion of the top wall of cylindrical recess 4 communicates with an air return chamber 6 extending in axial direction in the cylindrical head 1.

The central portion of the bottom wall of the piston extension 2 has a conical recess 7 connected with filling sleeve 18 and supporting at its upper edge sealing element 8 in the form of a sealing ring which in the illustrated sealing position is compressed against rim 12 of bottle 9 positioned below the center of the filling sleeve 18 of the valve of this invention.

A cam follower 10 on the lateral wall of the piston extension 2 is directed reverse from the axis of rotation of the filling machine. During the rotation of the machine the follower 10 cooperates with a non-illustrated lifting cam and with a lowering cam 11 to move the piston extension 2 and thus the piston 3 through a predetermined stroke with respect to the stationary cylindrical head 1, the stroke being slightly larger than the overlap of the central conical recess 7 with respect to rim 12 of bottle 9. As it will be explained below, it is also necessary to lift during the displacement of bottle 9 the air-return pipe 26 out of the bottle so that the bottle exchange can take place.

The shift or exchange of the container is effected as follows:

Upon the completion of the filling process, which took place in the illustrated position of the filling valve of this invention, air-return pipe 26 is lifted, thereafter piston parts 2 and 3 are lifted by means of a non-illustrated lifting cam engaging the follower 10 to a level at which bottom wall 13 of piston extension 2 is above rim 12 of bottle 9. Whereupon bottle 9 without being moved in vertical direction is transported away in horizontal direction and replaced by an empty bottle. The new empty bottle is brought below the filling valve in a coarsely centered position. Subsequently, piston parts 2 and 3 are lowered by means of sinking cam 11 acting against projecting cam follower 10 or as the case may be the parts 2 and 3 sink by the effect of their own weight. During the sinking movement rim 12 of bottle 9 is finally centered by its engagement with the tapering surface of conical recess 7 and sealing element 8 abuts against the bottom rim 12.

The filling process starts with the introduction of pressurized gas into air return chamber 6 in the cylinder head 1 and thus into cylindrical recess 4. As a consequence piston 3 and piston extension 2 with sealing ring 8 are pressed against bottle rim 12 with a predetermined sealing force which preferably depends on the gas pressure in the sealed container. This compression force corresponds to the pressure of pressurized gas times the surface difference between the surface of piston 3 and the surface of bottle rim 12.

The processed liquid is fed into bottle 9 through lateral inlet channel 14 opening into valve chamber 15 provided in the piston extension 2. Valve chamber 15 contains a valve member 16 which is movable in two opposite vertical directions. In the lower position of valve member 16, the latter rests with its sealing ring 17 around the filling sleeve 18 in the bottom wall of valve chamber 15. Another sealing ring 28 arranged around the upper portion of valve member 16 separates together with the bottom sealing ring 17 the liquid inlet channel 14 from the liquid discharge sleeve 18, whereby the latter communicates through sealing ring 8 with the neck of bottle 9.

Valve member 16 is provided with a lateral recess 21 cooperating with a lifting and lowering mechanism consisting of a rotary shaft 19 passing through a lateral wall of piston extension 2 opposite the recess 21 of the valve member 16 and being provided at the inner end thereof with cam 20 cooperating with the recess 21 for lifting and lowering the valve member 16. For this purpose, the outer end of shaft 19 is connected to cam follower 22 which is operated by means of non-illustrated lifting and lowering cams which during the rotation of the filling machine control the cam follower 22 and thus the inner cam 20 in such a manner that valve member 16 is lifted about a small distance above the bottom of valve chamber 15 to open the connection between the liquid inlet passage 14 and the discharge sleeve 18. Upon the completion of the filling action, cam 20 again lowers until sealing ring 17 seals the discharge sleeve 18.

The liquid inlet passage 14 is arranged in the piston extension 2 on a lateral side toward the axis of rotation of the filling machine. A tubular inlet piece having an outer portion of increased diameter is inserted into passage 14, the inner wall of the extended outer portion supporting an elastic sealing ring 24. This elastic sealing ring 24 supports in turn the end portion of a rigid liquid feeding pipe 25 in such a manner that the latter is in sealing contact with the ring even when subject to rotation during the relatively short stroke of piston parts 2 and 3 and moves without touching the inner wall of the extended tubular portion 23. The rigid pipe 25 spans a longer distance such as, for instance, more than 1 meter, and leads to a connection on a liquid storing tank which is arranged, for example, in the center of rotation of the filling machine. The elastic coupling to the outlet connection of the tank at the other end of rigid pipe 25 corresponds to the connection 23, 24 and 25 to the piston extension 2. Accordingly, the pipe 25 is supported only at its two ends by respective sealing rings 24. As mentioned above, due to relatively small vertical displacement of piston parts 2 and 3 a relatively small change of angular position of the relatively long pipe 25 takes place and the angular changes can be intercepted by the elastic sealing rings.

Return pipe 26 passes through an axial bore in piston parts 2 and 3 and projects upwardly through cylindrical recesses 4 into air return chamber 6. An intermediate portion of air-return pipe 26 is in sliding contact with a sealing ring 45 arranged in the bore portion in piston 3. A similar axial boring of larger diameter is also provided in valve member 16 so that a return pipe 26 passes through this increased boring without contacting the valve member. The aforementioned upper sealing ring 28 prevents the liquid filled into bottle 9 from leaking through the upper part of valve chamber 15 into the boring 27. Since by this means no overflow of the liquid can take place when valve member 16 is closed, no additional seal in boring 27 of valve member 16 is necessary.

The upper portion of air-return pipe 26 projects as mentioned above into air return chamber 6 provided in the upper part of cylindrical head 1 and in the range of this chamber the pipe 26 is provided with a toothed rack 29. The rack is in mesh with a pinion 30 which is supported for rotation in a recess in the inner wall of the air-return chamber 6. The shaft of pinion 30 is rotatably supported in the walls of head 1 whereby the projecting end of the shaft (not illustrated) is connected to lever 31 which at its free end supports a cam follower 32.

A setting screw 34 is provided in a threaded hole in a projection 33 extending from cylindrical head 1 opposite the pinion lever 31 and forms a stop for this lever. Cam follower 32 during the rotation of the filling machine comes into engagement with a non-illustrated sinking cam as well as with a lifting cam 35 and the resulting reciprocating movement is transmitted through the rack-and-pinion transmission 29 and 30 to the air-return pipe 26.

In the filling position of the filling valve as illustrated in the drawing, the air-return pipe 26 in its lowermost position in which its lower end portion is introduced into the bottle to determine the filling level. This lowermost position of the pipe 26 corresponds to the lifted position of the control lever 31 for the pinion 30. Upon completion of the filling process and prior to the replacement of the bottle 9 control lever 31 is lowered by means of the aforementioned lowering cam and pipe 26 is raised above the bottom surface 13 of the piston extension 2. As it has been already described above, the piston parts 2 and 3 have to be raised a small distance above the bottle rim 12 so as to completely remove the bottle from the conical recess 7.

In the illustrated filling position of the filling valve the vertical position of the air-return pipe 26 within the bottle 9 has to be set very accurately in order to insure that its bottom edge projecting into the interior of bottle 9 be always accurately positioned at the desired filling level. In the illustrated exemplary embodiment, filling position of the air-return pipe 26 can be very accurately adjusted by the adjustable stop 34 of the pinion lever 31. This stop member 34 in the form of an adjustment screw enables compensation for all inaccuracies of the filling machine or for the tolerance occurring in the filling valve proper. In a preferred embodiment, a lifting cam 35 is spring loaded to avoid any damage and corresponding springs can be provided also between the lever 31 and the cam follower 32.

In another non-illustrated embodiment of this invention the vertical position of the lifting cam 35 is adjustable while the adjustment screw is eliminated. The exact filling position of the air-return pipe 26 is adjusted by means of this lifting cam. The advantage of the latter embodiment is the fact that during rotation of the filling machine all filling valves are controlled by the same lifting cam 35 to insure identical filling position of their return pipes. This vertically adjustable lifting cam 35 is preferable in the case when batches of different containers requiring different filling levels are to be rapidly processed in the same filling machine.

The top of the cylindrical head 1 is provided with connection 44 for pressurized gas which is in alignment with the axial boring for return pipe 26 and is further provided with a pressure valve. The valve consists of a valve chamber 38 having at its bottom a downwardly tapering conical seat 36 communicating with the air-return chamber 6 through a short axial boring portion 39. The axial boring portion 39 is normally closed by valve ball 37 of a plastic material, for example. Ball 37 is freely movable in valve chamber 38 and rests on its conical seat 36 with a very small force corresponding to its own weight.

The top end of air-return pipe 36 is provided with an axial projection 40 below which apertures 41 insure communication of the interior of pipe 26 with air-return chamber 6. The outer diameter of the top projection 40 is smaller than the inner diameter of boring portion 39 and the length of the projection 40 is sufficient to lift the valve ball when pipe 26 is raised during the exchange of the container.

Valve ball 37 in connecting piece 44 is constantly subject to the pressure of pressurized gas and normally is sealingly pressed against its seat 36. At the beginning of the filling process the pressure valve 36 and 37 has to be momentarily open in order to pressurize the air-return chamber 6 and the inner space of bottle 9 communicating with the latter. For this purpose control lever 31 for lifting the air-return pipe 26 is momentarily actuated by an additional lowering cam (not shown) to impart an additional lift to pipe 26 during which the projection 40 at the top end of pipe 26 raises the valve ball 37 and opens the passage through-boring portion 39.

During this instant opening of the unidirectional valve 36 and 37 the pressurized gas from conduit 44 enters the interior of bottle 9 and the pressure relief valve 37 and 36 can be closed again by lowering the pipe 26. Subsequently, the filling operation takes place during which the level of liquid charged into bottle 9 keeps raising and through air-return pipe 26 air from the interior of the bottle is expelled into the air-return chamber 6. The increased pressure in chamber 6 resulting from the returning air raises again the light valve ball 37 and the excess air is compelled back into the pressure gas conduit 44. In the event that bottle 9 breaks during the filling process, the ball valve 37 automatically and without any delay seals its valve seat 36.

In addition, a pressure relief valve 43 in a pressure relief conduit 42 is provided at the top of air return chamber 6. The pressure relief valve 43 is normally closed by the action of a spring as well as by the pressure of pressurized gas in chamber 6 and is operated by an additional non-illustrated cam to release pressure from air-return chamber 6. The pressure relieving operation takes place in a conventional manner at the end of the filling operation. This pressure relieving step serves for equalizing pressure in the residual free space in the charged bottle 9 and in the interconnected gas spaces in the filling valve with the pressure of outer atmosphere so that the filled liquid in the bottle be prevented from foaming when the filling valve is removed. The pressure release takes place gradually by a suitable activation of the pressure relieving valve 43 and by forming conduit 42 as a throttling conduit. Due to the arrangement the pressure relief conduit at an elevated point in the filling valve insures that no liquid sprayed on the inner walls of the filling valve is taken along by the streaming gas. Nonetheless, it is still necessary to insure that during the pressure relieving operation at the end of the filling process the air-return pipe 26 is empty and free of any liquid. This requirement could be met by a valve member at the lower end of the air-return pipe 26. With the shown embodiment not having such a valve member, care must be taken, however, that upon completion of the filling process the liquid column remaining in the air-return pipe 26 be discharged prior to the initiation of the pressure relieving process. This residual liquid column is discharged automatically by lifting pipe 26 before the pressure relieving step is initiated. Due to the fact that the spaces in the filling valve communicating with the ends of the air-return pipe are sealed with respect to each other during the lifting movement of the pipe, by lifting the pipe 26 gas is pushed through the pipe pushing the fluid column downwardly.

In a modification of the illustrated embodiment the lower part 2 of the filling valve may be designed integral with the cylinder, the piston then being provided at the head 1. Nonetheless, the condition that the cylinder piston unit is arranged above the pressure controlling valve 15 and 16 is to be maintained.

As can be seen from the drawing, the arrangement of the filling valve according to this invention in which all liquid conducting components are arranged in the lower part 2 of the valve presents from the viewpoint of fluid technology optimum design possibilities. For example, the part of valve chamber 15 below the upper sealing ring 28 of the valve member 16 can have an arbitrary size and can be designed as a spin generating spiral inlet chamber.

Also the lifting and lowering mechanism for the air-return pipe 26 can be designed in a different manner as illustrated. For instance, the air-return pipe can be lifted by means of a fork lever and the like. The air-return pipe lifting mechanism can be arranged also in the lower part of the filling valve if desired. The illustrated preferred embodiment in which the air-return pipe driving mechanism is arranged above the liquid controlling chamber is more advantageous since it will not interfere with the operation of the liquid valve arrangement.

By a suitable modification of the liquid discharging parts 7, 8 and 18 the filling valve of this invention can be employed also for filling cans. For this purpose the valve portion in the region of the sealing element 8, can be made exchangeable, for example. In this case it is possible to fill with the same filling valve the bottles and alternatively, the cans. The adjustment of the filling level in the container by adjusting the insertion of return pipe 26 into the latter is considerably facilitated by the above-described structure of the filling valve.

It will be understood that each of the elements described above, or two or more together, may also find a useful application in other types of constructions differing from the types described above.

While the invention has been illustrated and described as embodied in a filling valve arrangement for use with rotating filling machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A device for filling gas-pressurized liquid into containers, comprising a housing having a lower section provided with an opening adapted to communicate with containers to be filled, and an upper section provided with an air return chamber; an air return pipe reciprocably mounted in said housing between a lower position in which it partly enters a container to be filled, and an upper position in which it is upwardly retracted from the container, said air return pipe having an upper portion located in said air return chamber and axially spaced pipe openings which are permanently open to the first mentioned opening and to said air return chamber, respectively; and means for raising and lowering said air return pipe between said positions thereof, including a rack on said upper portion and a direction-reversible rotary drive shaft sealingly extending through a wall bounding said air return chamber and having an inner portion located therein, said inner portion having a pinion meshing with said rack.

2. A device as defined in claim 1, wherein said shaft has a projecting end connected to a driving lever, said housing supporting an adjustable stop member located opposite said driving lever to adjustably limit its movement.

3. A device as defined in claim 1, for use in connection with a rotary filling machine, wherein a control cam is fixedly supported on the filling machine to cooperate with a driving lever driving said pinion for imparting the reciprocating vertical movement to said air-return pipe.

4. A device as defined in claim 1, further including a gas valve arranged in said housing opposite said upper portion of said pipe, said raising and lowering means being operable for momentarily lifting said pipe against said gas valve to open the latter for introducing gas into said container.

5. A device as defined in claim 4, wherein said gas valve is a ball valve the ball of which during the filling operation is lifted by the return air.

6. A device as defined in claim 1, further including a valve chamber for admitting the pressurized liquid into said container, said air-return pipe passing through said valve chamber and being sealingly guided in the region between said valve chamber and said air-return chamber, and a pressure-relief valve arranged in said housing in said air-return chamber.

* * * * *